US005799471A

United States Patent [19]

Chen

[11] Patent Number: 5,799,471

[45] Date of Patent: Sep. 1, 1998

[54] STEPLESSLY ADJUSTABLE PRE-STRETCHED FILM WRAPPING APPARATUS

[76] Inventor: Tsung-Yen Chen, 2F, No. 4, Alley 3, Lane 423, Sec. 5, ChungHsiao E. Road, Taipei, Taiwan

[21] Appl. No.: 721,322

[22] Filed: Sep. 26, 1996

[51] Int. Cl.[6] ..... B65B 53/00

[52] U.S. Cl. ..... 53/556; 476/47; 476/49; 476/50

[58] Field of Search ..... 53/556, 441; 226/111, 226/178, 188; 476/47, 49, 50

[56] References Cited

U.S. PATENT DOCUMENTS

| | | | |
|---|---|---|---|
| 2,509,940 | 5/1950 | Rennerfelt | 476/49 |
| 2,794,346 | 6/1957 | Frost | 476/49 |
| 4,919,002 | 4/1990 | Kume | 476/49 |
| 5,301,493 | 4/1994 | Chen | 53/556 |

*Primary Examiner*—Linda Johnson
*Attorney, Agent, or Firm*—Beveridge, DeGrandi, Weilacher & Young LLP

[57] ABSTRACT

A steplessly adjustable pre-stretched film wrapping apparatus includes a downstream film roller driven by a motor through a first shaft and an upstream film roller connected to the downstream roller with a steplessly adjustable mechanical coupling system for unwinding and stretching a film web from a film roll and extending therebetween. The coupling system includes an input disk mounted to an input shaft that is driven by the motor and in turn drives the downstream roller and having a thickness gradually reduced from a center portion to the peripheral edge, and an output disk mounted to an output shaft that drives the upstream roller and having a thickness gradually reduced from a center portion to the peripheral edge thereof. A pair of cramp disks are mounted on a floating shaft which is manually movable between the input disk and the output disk to change the center distance between the floating shaft and both of the input and output shafts. The cramp disks define therebetween a gap which receives and crampingly engages, by being biased by springs, the reduced peripheral edges of the input and output disks to therein so as to transmit the rotation from the input disk to the output disk. Changing the center distance between the floating shaft and the input and output shafts, respectively, provides a stepless adjustment of speed ratio between the input shaft and the output shaft.

8 Claims, 3 Drawing Sheets

STEPLESSLY ADJUSTABLE PRE-STRETCHED FILM WRAPPING APPARATUS

FIELD OF THE INVENTION

The present invention relates generally to a palletized package load wrapping apparatus and in particular to a wrapping apparatus which applies a pre-stretched film web in a steplessly adjustable way to over-wrap the palletized load.

BACKGROUND OF THE INVENTION

In the past, apparatus have been widely used in providing a unitary package by applying a suitably stretched film web to over-wrap a load on a pallet to facilitate long distance or overseas transportation of the palletized packages. In the early days, the film wrapping apparatus simply comprises a roll of film web and a mechanism to unwind the film web from the roll to over-wrap the load on a pallete. This early simple configuration of film wrapping apparatus often causes "necking" of the film web and results in breaking at the corners of the load.

Thus, pre-stretching of the film web is adapted to overcome these problems. The pre-stretching operation of the film web is usually done by means of a high speed shaft and a low speed shaft, each having a roller to escort the film in different speeds so as to stretch the film to a controlled and desired extent. One conventional design of the pre-stretching mechanism comprises a gear train to mechanically couple the two shafts to a common motor and to drive the two shafts at different speeds. Since the gear train itself is a "rigid" mechanical coupling, the speed ratio between the two shafts is fixed and it is very difficult, if not impossible, to change the speed ratio.

A later development of the wrapping apparatus uses two motors to independently drive the two shafts. This allows a stepless adjustment of the speed ratio between the two shafts. However, due to the extension of the film between the two shafts, the low speed shaft is inevitably sped up by the high speed shaft. This causes an imprecise and incorrect pre-stretching of the film.

Another conventional design is to provide a motor to drive the high speed shaft, but mount a braking or deceleration device on the low speed shaft so that when the high speed shaft is driven by the motor to pull the film, the braking device of the low speed shaft is adjusted in accordance with desired stretching of the film to control the speed of the low speed shaft. This also provides a stepless adjustment of the film stretching. However, due to the heat generated by the friction on the braking device, the braking device will gradually lose its precision.

In U.S. Pat. No. 5,301,493 which was filed by the applicant on Sep. 25, 1992 and issued on Apr. 12, 1994, another design of stepless adjustment of the film wrapping device is disclosed, wherein a mechanical coupling is provided between the high speed shaft and the low speed shaft, the mechanical coupling comprising a disk co-axially fixed to the low speed shaft and an elongated cylinder mechanically connected, by means of a bevel gear pair, to the high speed shaft to be rotated in synchronization therewith so as to have the rotational axis of the cylinder perpendicular to that of the low speed shaft. An idle roller is arranged between the disk and the cylinder and in contact engagement therewith so as to transmit the rotation of the cylinder to the disk. The idle roller is radially movable on the disk surface so as to adjust the speed ratio between the disk and the cylinder and thus achieve a stepless adjustment.

A disadvantage associated with the prior art U.S. patent is that to ensure a non-slippage contact engagement between the idle roller and the disk and the cylinder, a high friction material coating, such as rubber or polyurethane, is needed between the contact areas. The high friction material will be gradually worn out, causing imprecise control of the stretching ratio of the film.

Examples of other related prior art patents include U.S. Pat. Nos. 4,302,920, 4,387,552, 4,706,443 and 5,081,824.

It is therefore desirable to provide a pre-stretched film wrapping apparatus which comprises an improved steplessly adjustable mechanical coupling between the high speed downstream) roller and the low speed (upstream) roller to provide a stepless speed ratio adjustment therefor.

OBJECTS OF THE INVENTION

It is the principle object of the present invention to provide a steplessly adjustable pre-stretched film wrapping apparatus which provides long term precision in the stepless adjustment of the speed ratio between the downstream roller and the upstream roller.

It is another object of the present invention to provide a steplessly adjustable pre-stretch film wrapping apparatus which needs no frequent change of the parts in order to maintain the workability and the stretching precision.

To achieve the above-mentioned object, there is provided a steplessly adjustable pre-stretched film wrapping apparatus comprising a downstream film roller driven by a motor through a first shaft and an upstream film roller connected to the downstream roller with a steplessly adjustable mechanical coupling system for unwinding and stretching a film web from a film roll and extending therebetween. The coupling system comprises an input disk mounted to an input shaft that is driven by the motor and in turn drives the downstream roller and having a thickness gradually reduced from a center portion to the peripheral edge thereof and an output disk mounted to an output shaft that drives the upstream roller and having a thickness gradually reduced from a center portion to the peripheral edge thereof. A pair of cramp disks are mounted on a floating shaft which is manually movable between the input disk and the output disk to change the center distance between the floating shaft and the input and output shafts. The cramp disks define therebetween a gap which receives and crampingly engages, by being biased by springs, the reduced peripheral edges of the input and output disks to therein so as to transmit the rotation from the input disk to the output disk. Changing the center distance between the floating shaft and the input and output shafts provides a stepless adjustment of speed ratio between the input shaft and the output shaft.

Other objects and advantages of the invention will be apparent from the following description of a preferred embodiment taken in connection with the attached drawings, in which:

DETAILED DESCRIPTION OF THE PREFERRED EMBODIMENT

Figure 1:
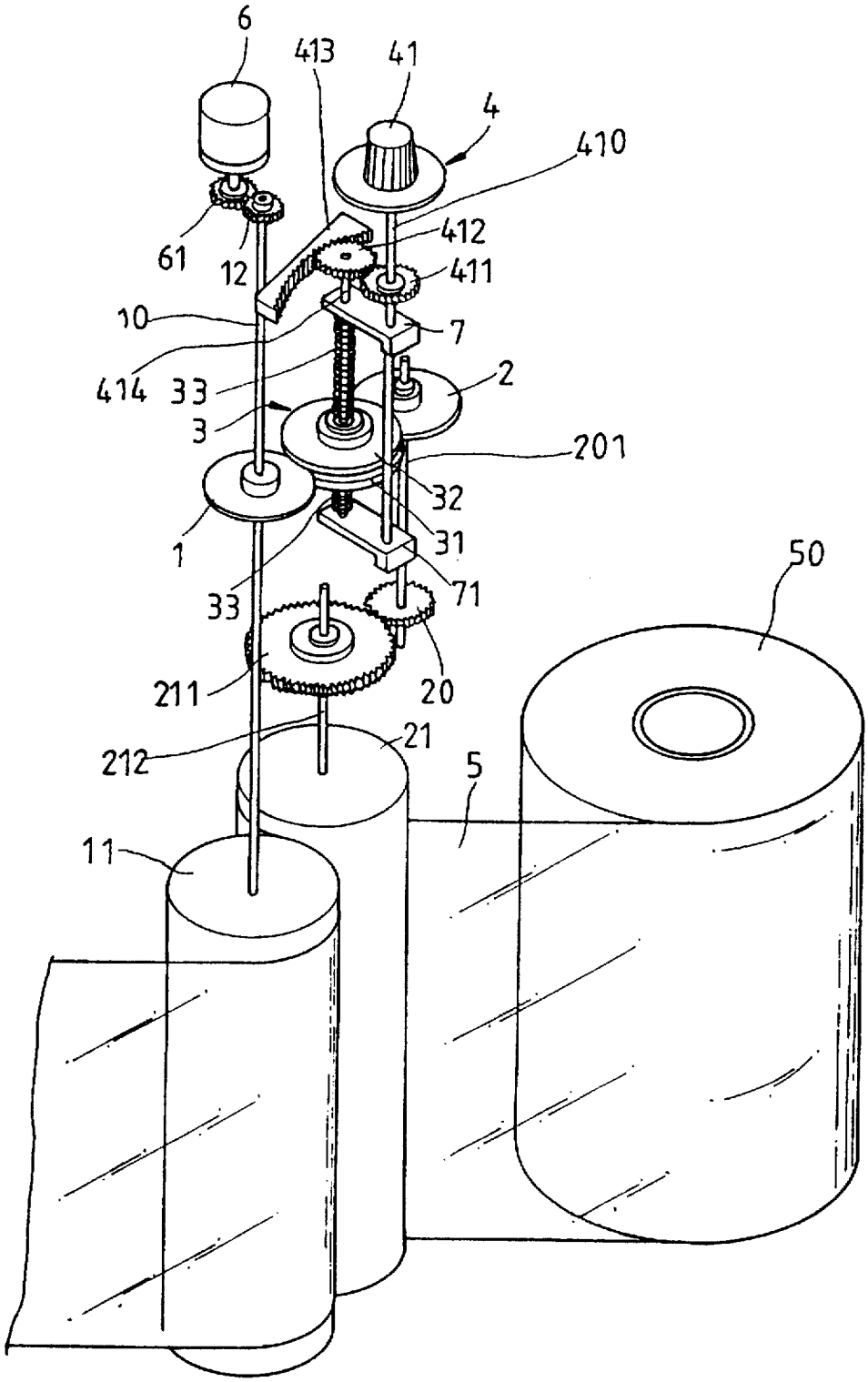
FIG. 1 is a perspective view showing a steplessly adjustable pre-stretched film wrapping apparatus in accordance with the present invention.

With reference to the drawings and in particular to FIG. 1, wherein a stretch wrapping apparatus of the present invention is shown, the stretch wrapping apparatus of the present invention comprises a high speed downstream roller 11 driven by a torque source, such as a motor 6, via an input shaft 10 and a lower speed upstream roller 21 mechanically connected to the downstream roller 11 with an adjustable mechanism coupling system 3. A film web 5 unwound from a film roll 50 extends between the upstream roller 21 and the downstream roller 11 to be stretched therebetween to provide a pre-stretched film for over-wrapping a load (not shown).

In the embodiment illustrated, the input shaft 10 is connected to the motor 6 by means of a gear 12 fixed thereon and engaging an output pinion 61 mounted to a spindle of the motor 6.

Figure 2:
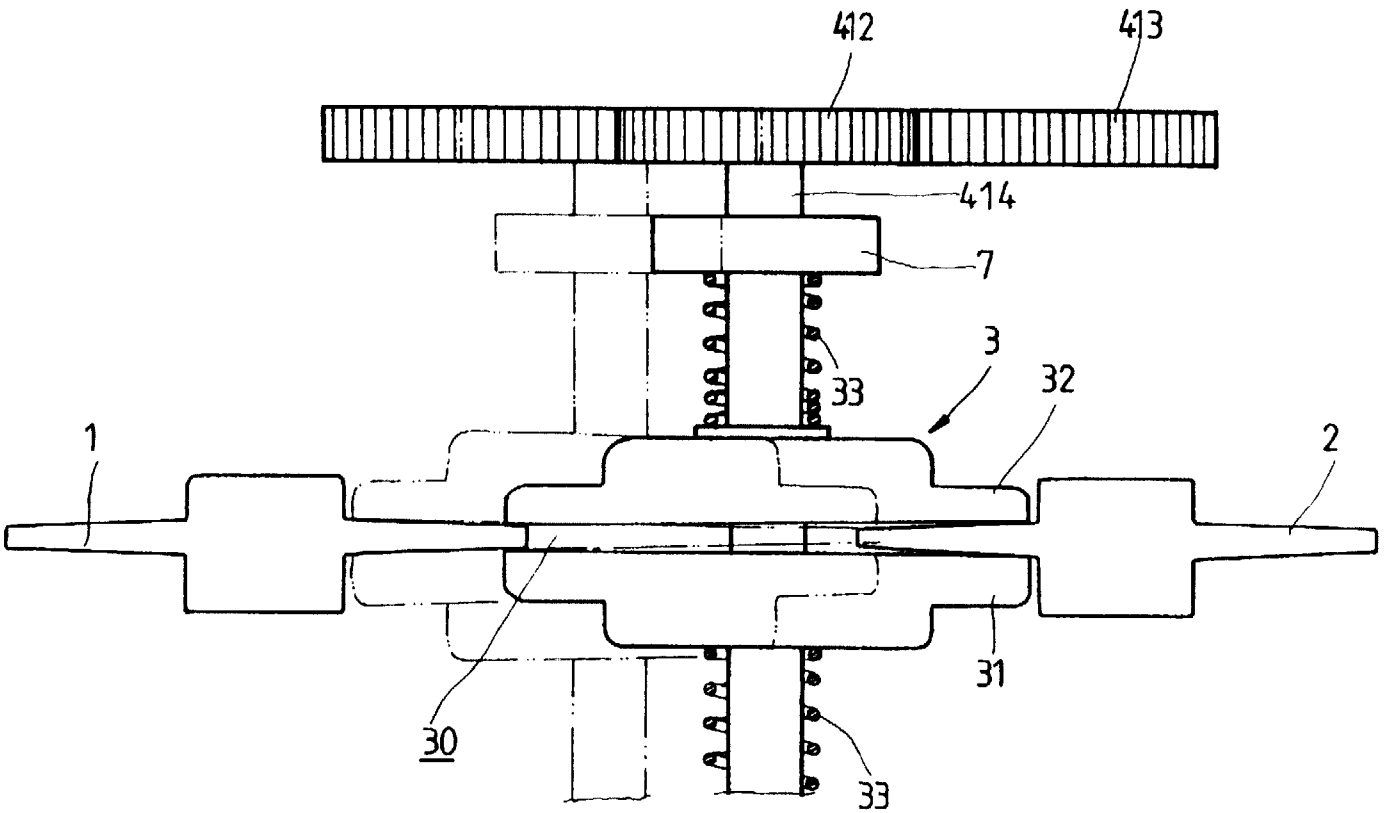
FIG. 2 is an enlarged side elevational view showing the mechanical coupling system connected between the downstream roller and the upstream roller of the film wrapping apparatus of the present invention.

Also referring to FIG. 2, the adjustable coupling system 3 comprises an output shaft 201 connected to a rotational shaft 212 of the upstream roller 21 to drive the upstream roller 21. In this respect, a gear pair, comprising a gear 20 fixed to the output shaft 201 and a gear 211 fixed to the rotational shaft 212 of the upstream roller 21, is provided to mechanically couple the rotational shaft 212 to the output shaft 201. Preferably, the gears 20 and 211 form a reduction gear pair between the output shaft 201 and the rotational shaft 212, namely, gear 20 is smaller than gear 211.

An input disk 1 is co-axially fixed on the input shaft 10 and an output disk 2 is co-axially fixed on the output shaft 201. Each of the disks 1 and 2 has a configuration that has a cross-sectional thickness reduced from a first thickness at a central portion thereof toward a second thickness of a circumference of the disk 1 or 2, the second thickness being smaller than the first thickness, as shown in FIG. 2, so as to define inclined top and bottom surfaces of the disks 1 and 2.

The coupling system 3 comprises a floating shaft 414 on which two cramp disks 31 and 32 are co-axially mounted to be rotatable about and axially movable along the floating shaft 414. The two cramp disks 31 and 32 defines therebetween a nip space 30 for receiving and cramping an edge portion of each of the two disks 1 and 2. Biasing means, such as springs 33 are provided on the floating shaft 414 to bias the cramp disks 31 and 32 toward each other for securely engaging and cramping the input and output disks 1 and 2 so that when the input disk 1 is rotated, the engagement between the input disk 1 and the cramp disks 31 and 32 forces the cramp disks 31 and 32 to rotate about the floating shaft 414. The rotation of the cramp disks 31 and 32 is in turn transmitted to the output disk 2 via the engagement therebetween to apply an output rotational motion to the output shaft 201 which in turn drives the rotational shaft 212 of the upstream roller 21.

The coupling system 3 further comprises a control device 4 for adjusting the location of the floating shaft 414 and thus the cramp disks 31 and 32 with respect to the input disk 1 and the output disk 2, which control device 4 comprises means for rotating the floating shaft 414 about an axis which in the embodiment illustrated takes the form of a shaft 410 located on an imaginary plane that is substantially normal to and bisecting a plane connecting the input and output shafts 10 and 201. The shaft 410 is located at a pre-determined distance from the plane connecting the input and output shafts 10 and 201 so that the floating shaft 414 is movable along an arc path defined by a circle centered at the axis 410. This allows the floating shaft 414 and thus the cramp disks 31 and 32 to move with respect to the input disk 1 and output disk 2.

The control device 4 comprises a gear 412 fixed on the floating shaft 414 which engages a arc rack 413 substantially concentric with the arc path of the floating shaft 414 and a control pinion 411. The control pinion 411 is manually rotatable via a manual knob 41. The rotation of the manual knob 41 drives the gear 412 to rotate and move along the rack 413 and thus adjusting the location of the floating shaft 414 and thus the cramp disks 31 and 32 with respect to the input disk 1 and the output disk 2.

In the embodiment illustrated, the control pinion 411 is mounted on the shaft 410 and the manual knob 41 is also fixed to the shaft 410. It is however possible to arrange the control pinion 411 and the manual knob 41 in different ways.

In the embodiment illustrated, to support the rotation of the floating shaft 414 about the axis 410, an upper support plate 7 and a lower support plate 71 are provided to connect the floating shaft 414 to the shaft 410 in such a manner to allow the floating shaft 414 to rotate relative to the shaft 410.

The support plates 7 and 71 also serve as means for supporting and holding the springs 33 on the floating shaft 414 to bias the cramp disks 31 and 32 toward each other.

Figure 3:
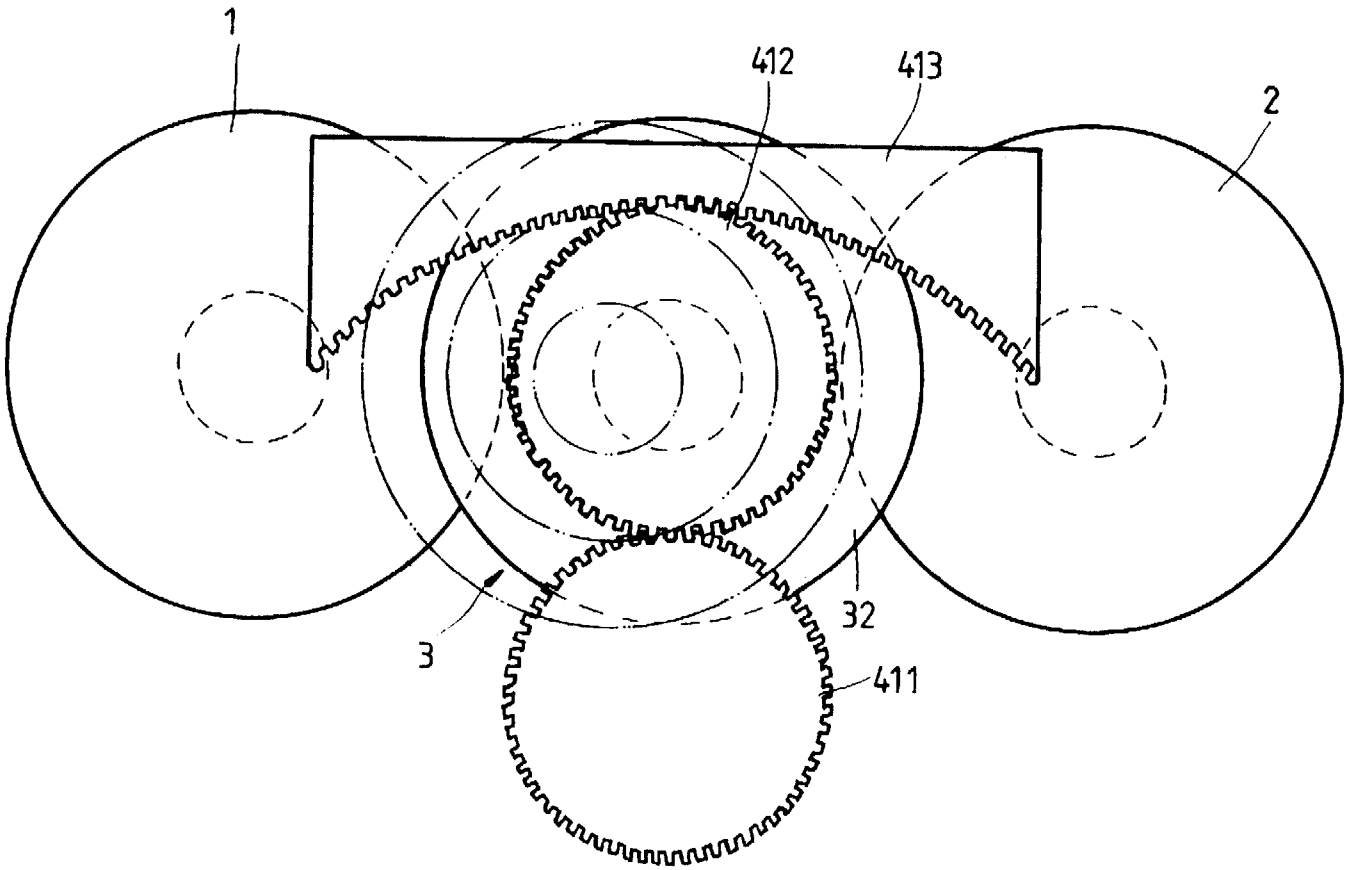
FIG. 3 is a plan view showing the adjustment of the mechanical coupling system of the present invention.

Referring to FIGS. 2 and 3, by moving the cramp disks 31 and 32 relative to the input disk 1 and the output disk 2, the distance between centers of the input disk 1 and the cramp disks 31 and 32 which will be referred to as input disk center distance and that between the output disk 2 and the cramp disks 31 and 32 which will be referred to as output disk center distance are changed. By moving the cramp disks 31 and 32 toward the input disk 1, as shown in-phantom lines in FIGS. 2 and 3, the input disk center distance is decreased and the circumferential edge of the input disk 1 is moved more deeply into the nip space 30 between the cramp disks 31 and 32. This increases the speed ratio between the input disk 1 and the cramp disks 31 and 32 and thus the speed ratio between the input disk 1 and the output disk 2. If the cramp disks 31 and 32 are moved toward the output disk 2, then the input disk center distance is increased and the output disk center distance decreased. This decreases the speed ratio between the input disk 1 and the cramp disks 31 and 32 and thus the speed ratio between the input disk 1 and the output disk 2.

With such an arrangement, a stepless adjustment of the speed ratio between the input disk 1 and the output disk 2 is achieved by manually rotating the manual knob 41 to move the gear 412 along the rack 413.

It is apparent that although the invention has been described in connection with a preferred embodiment, those skilled in the art may make changes to certain features of the preferred embodiment without departing from the spirit and scope of the invention as defined in the appended claims.

What is claimed is:

1. A steplessly adjustable pre-stretched film wrapping apparatus comprising:

a downstream film roller driven by a motor via an input shaft with a first rotational speed;

an upstream film roller driven by an output shaft with a second rotational speed with a film web unwound from a film roll extending therebetween and partially wrapping around the upstream and downstream film rollers to be stretched thereby; and an adjustable mechanical coupling system being provided to couple the output shaft to the input shaft, the adjustable mechanical coupling system including an input disk fixed on and rotated by the input shaft, an output disk fixed on the output shaft, each of the input and output disks having a circumferential edge, a floating shaft having two cramp disks rotatably supported thereon to define therebetween a nip space for receiving and engaging therein the circumferential edges of the input and output disks with an input disk center distance present between the input shaft and the floating shaft and an output disk center distance between the floating shaft and the output shaft for transmitting the first rotational speed of the input shaft to the cramp disks which in turn apply the second rotational speed to the output disk, biasing means being provided on the floating shaft to bias the cramp disks toward each other for securely engaging and cramping the circumferential edges of the input and output disks between the cramp disks, and manual adjusting means for moving the floating shaft with respect to the input and output shafts to change the input disk center distance and the output disk center distance.

2. The apparatus as claimed in claim 1, wherein the input disk includes a central portion having a first thickness, the circumferential edge of the input disk having a second thickness which is smaller than the first thickness so as to define inclined top and bottom surfaces of the input disk.

3. The apparatus as claimed in claim 1, wherein the output disk includes a central portion having a third thickness, the circumferential edge of the output disk having a fourth thickness which is smaller than the third thickness so as to define inclined top and bottom surfaces of the output disk.

4. The apparatus as claimed in claim 1, wherein the biasing means includes helical springs encompassing the floating shaft and each of the helical springs having an end supported against the cramp disks to bias the cramp disks toward each other.

5. The apparatus as claimed in claim 1, wherein the upstream film roller includes a rotational shaft on which the upstream film roller is fixed, the rotational shaft being coupled to and driven by the output shaft via a reduction gear pair.

6. The apparatus as claimed in claim 1, wherein the manual adjusting means includes a gear rotatably supported on the floating shaft, an arc rack engaged by the gear on the floating shaft, a manual knob, and a control gear which engages the gear on the floating shaft and is rotatable by the manual knob to move the gear on the floating shaft along the rack gear so as to move the floating shaft relative to the input and output shafts.

7. The apparatus as claimed in claim 6, wherein the floating shaft is connected to two support plates to be rotatably supported, each of the support plates being rotatably supported on a control shaft to which the manual knob and the control gear are fixed so as to allow the floating shaft to be rotatable about the control shaft by means of the rotation of the controls gear by the manual knob.

8. The apparatus as claimed in claim 7, wherein the biasing means includes two helical springs encompassing the floating shaft, each of the helical springs having an end supported on one of the support plates and an opposite end supported against one of the cramp disks to bias the cramp disks toward each other.

* * * * *